US009193207B2

(12) United States Patent
Zeng et al.

(10) Patent No.: US 9,193,207 B2
(45) Date of Patent: Nov. 24, 2015

(54) RECORDING MEDIUM HAVING A PROTECTIVE LAYER

(75) Inventors: Xi Zeng, San Diego, CA (US); Tao Chen, San Diego, CA (US); Eric L. Burch, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/369,141

(22) PCT Filed: Jan. 17, 2012

(86) PCT No.: PCT/US2012/021615

§ 371 (c)(1),
(2), (4) Date: Jun. 26, 2014

(87) PCT Pub. No.: WO2013/109254

PCT Pub. Date: Jul. 25, 2013

(65) Prior Publication Data

US 2015/0044397 A1 Feb. 12, 2015

(51) Int. Cl.

| | |
|---|---|
| ***B41M 5/00*** | (2006.01) |
| ***B41M 5/50*** | (2006.01) |
| ***B41M 5/52*** | (2006.01) |
| *B41M 7/00* | (2006.01) |

(52) U.S. Cl.

CPC ..... *B41M 5/502* (2013.01); *B41M 5/506* (2013.01); *B41M 5/5218* (2013.01); *B41M 5/5236* (2013.01); *B41M 5/5254* (2013.01); *B41M 5/5263* (2013.01); *B41M 7/0027* (2013.01); *B41M 2205/40* (2013.01)

(58) Field of Classification Search

CPC .. B41M 5/506; B41M 5/5218; B41M 5/5254; B41M 7/0027

See application file for complete search history.

(56) References Cited

U.S. PATENT DOCUMENTS

| | | | | |
|---|---|---|---|---|
| 6,114,020 | A | 9/2000 | Misuda et al. | |
| 6,357,871 | B1 * | 3/2002 | Ashida et al. | 347/106 |
| 6,670,000 | B1 | 12/2003 | Misuda et al. | |
| 6,811,253 | B1 | 11/2004 | King et al. | |
| 6,906,157 | B2 | 6/2005 | Leon et al. | |
| 2002/0037395 | A1 | 3/2002 | Zhong et al. | |
| 2003/0021987 | A1 | 1/2003 | Kobayashi et al. | |
| 2004/0109957 | A1 | 6/2004 | Sen | |
| 2004/0109958 | A1 | 6/2004 | Nigam et al. | |
| 2004/0253392 | A1 | 12/2004 | Kasperchik et al. | |
| 2006/0050130 | A1 | 3/2006 | Yoshida et al. | |
| 2007/0237909 | A1 | 10/2007 | McManus | |

FOREIGN PATENT DOCUMENTS

| | | |
|---|---|---|
| CN | 1723132 | 1/2006 |
| CN | 101415563 | 4/2009 |
| JP | 2005254769 | 9/2005 |
| JP | 2011213011 | 10/2011 |

* cited by examiner

*Primary Examiner* — Betelhem Shewareged

(74) *Attorney, Agent, or Firm* — Dierker & Associates, P.C.

(57) ABSTRACT

A recording medium includes a protective layer and a porous ink receiving layer. The protective layer includes a first binder and a first set of polymeric beads. The first set of polymeric beads has an average volume-based particle size equal to or greater than ten microns. The protective layer has a coat weight equal to or less than three grams per square meter. The recording medium also includes a porous ink receiving layer including a first set of pigments and a second binder.

14 Claims, 4 Drawing Sheets

RECORDING MEDIUM HAVING A PROTECTIVE LAYER

BACKGROUND

Recording media such as sheet media and web media may be used to receive pigmented ink to form images thereon. The images may be in a form of designs, symbols, photographs, and/or text. The pigmented ink may be applied to the recording media by an ink applicator unit.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

Throughout the drawings, identical reference numbers designate similar, but not necessarily identical, elements.

DETAILED DESCRIPTION

Figure 1A:
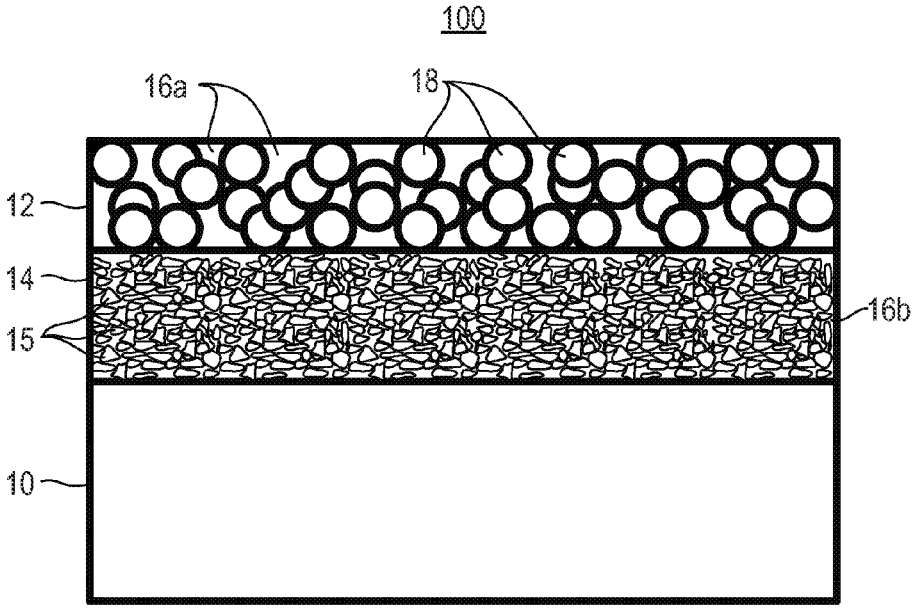
FIG. 1A is a cross-sectional view illustrating a recording medium according to an example.

Recording media such as sheet media or web media may be used to receive pigmented ink including ink pigments to form images such as designs, symbols, photographs, text, or the like. The pigmented ink may be in a variety of forms including latex-based inks. The pigmented ink may be applied by an ink applicator unit such as an inkjet printhead. For example, a printing system such as a retail-photo-system may include an inkjet printhead to apply pigmented ink including ink pigments to form of images such as photographs to a recording medium. The recording medium may be multi-layered. For example, the recording medium may include a base substrate and a top layer such as a fusible layer and/or a porous layer. Generally, pigmented ink printed on some porous and/or fusible top layers of recording media may remain on and/or in an upper portion of the top layer. For example, even in some porous layers of recording media, solvent in the pigmented ink may be quickly absorbed resulting in the ink pigments aggregating together to form blockages such as bridges or filter cakes. Consequently, a filter-cake layer may form in the upper portion of the top layer and keep ink pigments on and/or in the upper portion of the top layer. Additionally, polymeric material in the fusible layer may become soft and coalescence to form a polymeric film layer to form a glossy image. Generally, the ink pigments in the glossy image also remain on or in the upper portion of the top layer. Accordingly, durability of images formed by the pigmented ink may be decreased due to its susceptibility to external forces such as scratching and abrasion applied to the top surface of the recording medium.

In examples, a recording medium includes, among other things, a base layer, a protective layer, and a porous ink receiving layer disposed between the base layer and the protective layer. The protective layer includes a first binder and a first set of polymeric beads. The first set of polymeric beads has an average volume-based particle size equal to or greater than ten microns. Volume-based particle size (hereinafter "particle size") may correspond to a diameter of a sphere that has a same volume as the respective particle. For example, the respective particle may be the respective polymeric bead. The protective layer has a coat weight equal to or less than three grams per square meter (gsm). The porous ink receiving layer includes a first set of pigments and a second binder. The size of the polymeric beads and the coat weight of the protective layer may enable pores and channels of a sufficient size in the protective layer to allow the passage of ink pigments there through into and/or below the lower portion of the protective layer. Accordingly, durability of images formed by the ink pigments of the pigmented ink may be increased due to its robustness to external forces such as scratches and abrasion applied to the top surface of the recording medium. That is, ink pigments below the upper portion of the protective layer may not be readily smeared or removed.

Figure 1B:
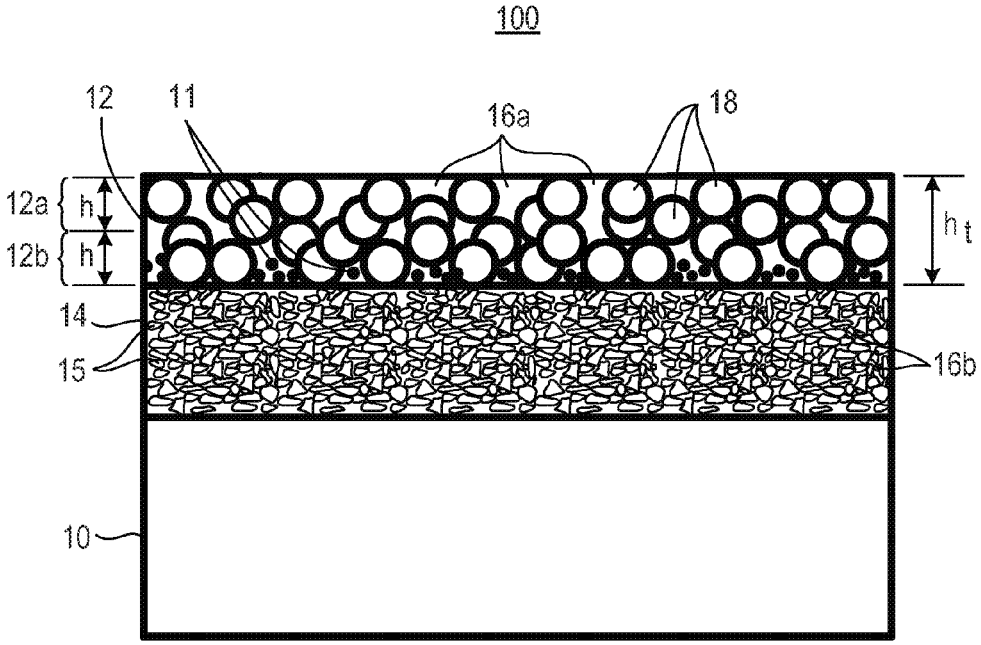
FIG. 1B is a cross-sectional view illustrating the recording medium of FIG. 1A, after receiving pigmented ink thereon, according to an example.

FIG. 1A is a cross-sectional view illustrating a recording medium according to an example. FIG. 1B is a cross-sectional view illustrating the recording medium of FIG. 1A, after receiving pigmented ink thereon, according to an example. Referring to FIG. 1A, in some examples, a recording medium 100 includes a base substrate 10, a protective layer 12, and a porous ink receiving layer 14 disposed between the base substrate 10 and the protective layer 12. The protective layer 12 may include a first binder 16*a* and a first set of polymeric beads 18. The first set of polymeric beads 18 may have an average particle size equal to or greater than ten microns. The protective layer 12 may also have a coat weight equal to or less than three gsm. Coat weight, for example, may correspond to a weight of a coating and/or layer applied to a substrate and/or layer. The porous ink receiving layer 14 may include a first set of pigments 15 and a second binder 16*b*.

Base Substrate

Referring to FIG. 1A, in some examples, the base substrate 10 may include cellulose fibers and/or synthetic fibers. The base substrate 10 may also include a polymeric binder. The polymeric binder may be included, for example, when non-cellulose fibers are used. In some examples, the base substrate 10 may include cellulose fibers and synthetic fibers. The cellulose fibers may be made from hardwood or softwood species. The synthetic fibers may be made from polymerization of organic monomers. In some examples, the base substrate 10 may include non-cellulose fibers. The base substrate 10 may be formed with a pilot paper machine with a pulp, or the like.

Alternatively, the base substrate 10 may include a coating layer on top of cellulose fibers and/or synthetic fibers. For example, the coating layer may include at least an inorganic pigment and a binder. Alternatively, the coating layer may include polymeric binders or resins. In some examples, the base substrate 10 may include an extruded polymeric film layer on top of cellulose fibers and/or synthetic fibers, such as photo base or photo paper. Still yet, the base substrate may include polymeric films, with or without a surface treatment or a surface coating layer.

Protective Layer

Referring to FIG. 1A, in some examples, the protective layer 12 may include a first set of polymeric beads 18 and a first binder 16*a*. In some examples, the protective layer 12 may also include a surfactant, defoamer, rheology modifier, pH controlling agent, dispersant, or the like. The protective layer 12 may be in the form of a coating. The protective layer 12 may be formed by pond coating, Meyer rod coating, blade coating, air-knife coating, curtain coating, or the like.

First Binder

The first binder 16*a* may include at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin. The latex resin may be based on at least one of a polymer and a copolymer of styrene butadiene, acrylic, styrene acrylic, styrene methylacrylate, styrene acrylonitrile, styrene maleic anhydride, vinyl acrylic, vinyl acetate, vinyl ester, and vinyl ether. The first binder 16*a* may provide adhesion between the polymeric beads 18. The first binder 16*a* may also provide adhesion between the protective layer 12 and porous ink receiving layer 14.

Polymeric Beads

Figure 3:
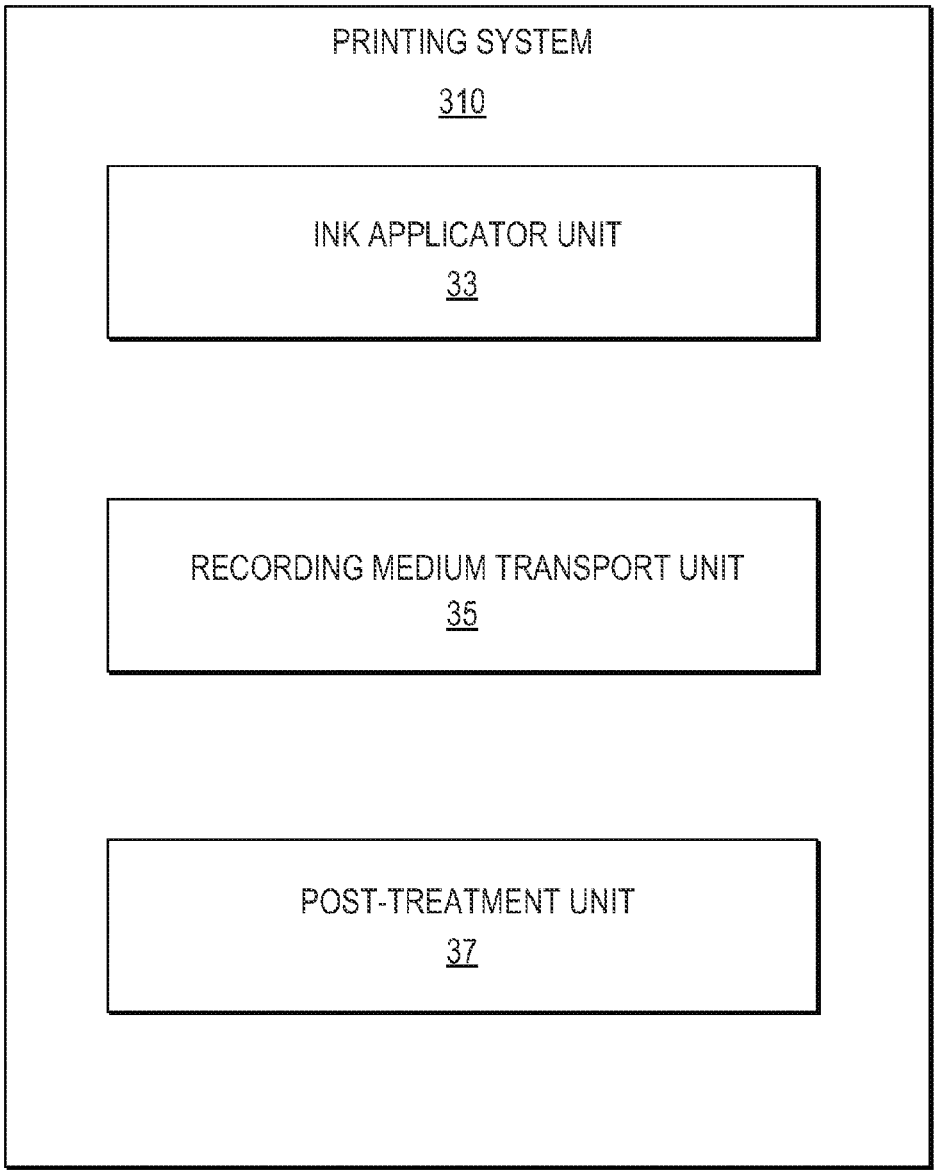
FIG. 3 is a block diagram illustrating a printing system to apply pigmented ink including ink pigments onto a recording medium according to an example.

The first set of polymeric beads 18 may include a synthetic polymer and/or a natural polymer. The synthetic polymer may include at least one of polyethylene, polypropylene, paraffin, polybutadiene, polyurethane, epoxy resin, silicone resin, polyamide resin, and latex resin. The latex resin, for example, may include at least one of styrene, styrene butadiene, styrene acrylate, styrene acrylic, ester, acrylic, acrylate, methylacrylate, vinyl ester, vinyl ether, and vinyl ketone. The natural polymer may include at least one of a natural wax, gelatin, gelatin derivative, cellulose, cellulose derivative, starch, and starch derivative. In some examples, the first set of polymeric beads 18 may have a melting temperature in a range between fifty ° C. and two hundred fifty ° C. In some examples, the melting temperature may be in a range of eighty ° C. to one hundred fifty ° C. For example, the melting point may correspond to preventing deformation of the polymeric beads 18 during the formation of the protective layer 12. The melting point may also correspond to enabling deformation of the polymeric beads 18 in the protective layer 12 after the passage of ink pigments 11 of the pigmented ink through the upper portion 12*a* thereof by a post-treatment unit 37 (FIG. 3).

The first set of polymeric beads 18 may be translucent and/or transparent to allow the color of the ink pigments 11 to be observed through the protective layer 12. For example, the ink pigments 11 may pass through the upper surface 12*a* of the protective layer 12 between the polymeric beads 18 to reside in or below the upper portion 12*a* of the protective layer 12. Thus, the ink pigments 11 may reside within and/or below the lower portion of the protective layer 12 and underneath respective polymeric beads 18. For example, the ink pigments 11 may reside between the protective layer 12 and the porous ink receiving layer 14. The polymeric beads 18 may include solid polymeric beads having a particle size larger than the respective ink pigments 11. In some examples, the polymeric beads 18 may have a spherical shape and a diameter corresponding to the volume-based particle size. Alternatively, the polymeric beads 18 may include shapes other than a spherical shape, including irregular shapes.

The size of the polymeric beads 12 and the coat weight of the protective layer 12 may enable pores and channels in the protective layer 12 to have a sufficient size to allow the passage of ink pigments 11 there through into and/or below the lower portion 12*b* of the protective layer 12. Accordingly, the ink pigments 11 may reside beneath the polymeric beads 18 which protective the ink pigments 11 there below. In some examples, the average pore size or opening of channels may be larger than one micron, for example, to accommodate an average particle size of ink pigments 11 in a range of fifty to two hundred nanometers.

Porous Ink Receiving Layer

Referring to FIG. 1A, in some examples, the porous ink receiving layer 14 may include a second binder 16*b* and a first set of pigments 15. The porous ink receiving layer 14 may include a large pore volume and a lot of small size pores to absorb, for example, ink solvent at a quick speed to allow it to penetrate through the upper portion 12*a* and/or lower portion 12*b* of the protective layer 12. Accordingly, images may be formed with good color gamut, sharp line edge, good resolution, or the like. The porous ink receiving layer 14 may include a swellable ink receiving layer, a raw paper base, or the like. The porous ink receiving layer 14 may be formed by pond coating, Meyer rod coating, blade coating, air-knife coating, curtain coating, or the like.

Second Binder

The second binder 16*b* may include at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin. The latex resin may be based on at least one of a polymer and a copolymer of styrene butadiene, acrylic, styrene acrylic, styrene methylacrylate, styrene acrylonitrile, styrene maleic anhydride, vinyl acrylic, vinyl acetate, vinyl ester, and vinyl ether.

Pigments

The first set of pigments 15 of the porous ink receiving layer 14 may include at least one of fumed silica, colloidal silica, precipitated silica, silica gel, boehmite, alumina, titanium dioxide, precipitated calcium carbonate, grounded calcium carbonate, clay, and calcined clay. In some examples, the porous ink receiving layer 14 may be in the form of a coating.

Referring to FIG. 1B, in some examples, the recording medium 10 may receive pigmented ink including ink pigments 11 to form images thereon. The recording medium 100 may include an upper portion 12*a* and a lower portion 12*b* each having a height h equal to one half a total height $h_t$ of the protective layer 12. That is, the respective height of the upper portion 12*a* is equal to the respective height of the lower portion 12*b* disposed below the upper portion 12*a*. Thus, the combined height of the upper portion 12*a* and lower portion 12*b* equals the total height $h_t$ of the protective layer 12. The pigmented ink is applied to the recording medium 100 such that the protective layer 12 includes a coat weight equal to or less than three gsm and a first set of polymeric beads 18 having an average particle size equal to or greater than ten microns.

Referring to FIG. 1B, in some examples, the size of the polymeric beads 18 and the coat weight of the protective layer 12 may enable pores and channels of a sufficient size in the protective layer 12 to allow the passage of ink pigments 11 there through into and/or below the lower portion 12*b* of the protective layer 12. Accordingly, durability of images formed by the ink pigments 11 may be increased due to its robustness to external forces such as scratches and abrasion applied to the top surface of the recording medium 100. That is, ink pigments 11 below the upper portion 12*a* of the protective layer 12 may not be readily smeared or removed.

In some examples, a post-treatment process may also be applied by a post-treatment unit 37. For example, pressure, heat, microwave, infrared radiation, UV light, or the like, may be applied to the protective layer 12 after the ink pigments 11 are transported through the upper portion 12*a* of the protective layer 12. Consequently, the polymeric beads 18 may fully or partially melt and/or deform to form a film layer to further protect the ink pigments 11 there below. For example, the pores or channels in the protective layer 12 may fully or partially close to further protect the ink pigments 11 there below. In some examples, the first set of polymeric beads 18 may have a melting temperature in a range between fifty ° C. and two hundred fifty ° C., including a range of eighty ° C. to one hundred fifty ° C. The melting point may correspond to preventing deformation of the polymeric beads 18 during the formation of the protective layer 12 and enabling deformation of the polymeric beads 18 in the protective layer 12 after the passage of ink pigments 11 through the upper portion 12*a* thereof by a post-treatment unit 37 (FIG. 3).

Test Results

Examples 1 through 5 in Table 1 illustrate formulations of the protective layer 12 of test samples of the recording medium 100 including polymeric beads. Each example in Table 1 includes a different set of polymeric beads identified therein. In the examples, the recording medium 100 is formed by a plurality of layers including a base substrate 10, a porous ink receiving layer 14, and a protective layer 12. The base substrate 10 is plain paper having about one hundred and fifty gsm, provided by Sappi. The porous ink receiving layer 14 is a twenty two gsm of fume-silica coating applied on the plain paper. The protective layer 12 was applied on the porous ink receiving layer 14. For each example, chemicals identified in Table 1 were mixed together in a beaker by using normal bench stirring equipment and were continually stirred for enough time to obtain a homogeneous mix. The homogenous mix was coated on the porous ink receiving layer 14 by using an appropriate Meyer Rod to obtain a coat weight of 3 gsm. The samples were subsequently dried by a normal heat gun in a lab.

Examples 1 through 5 in Table 2 correspond to the respective test samples of Table 1 in which images were printed thereon and subjected to visual and durability tests. Table 2 illustrates the average particle size of the respective polymeric beads used therein and the respective test results. Images were printed on the respective test samples with a HP Photosmart PM2000e printer. The printed images were visually inspected for obvious image defects such as bleeding, coalescence, area color fill, or the like. The test samples were also subjected to a finger nail scratch test in which a finger nail scratched the image area on the test samples. After the respective test samples were scratched, the image was carefully inspected for any removed ink or a scratch lines. In some cases, the printed samples were also subjected to a calendering process. The calendering process included passing the test samples with the printed images thereon through a lab calendering machine with a single nip to subject the printed images to a pressure of three thousand two hundred pounds per linear inch (pli) and a temperature of one hundred five ° C. After the calendaring process, the respective images were visually checked for defects and also subjected to a finger nail scratch test.

Figure 2:
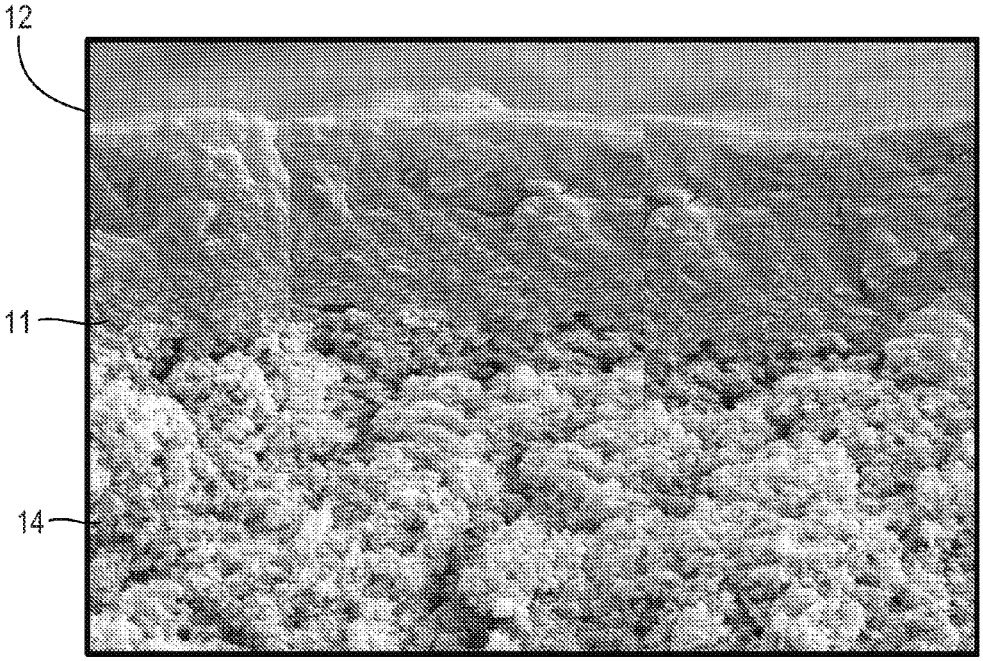
FIG. 2 is a scanning electron microscope photomicrograph of a cross-sectional view of a test sample of a recording medium printed on with pigmented ink according to an example.

Table 2 lists the average particle size of polymeric beads in the respective formulations and corresponding testing result for each sample. The results illustrate that when the average particle size of the polymeric beads in this protective layer was less than ten microns, the images appeared to have very poor scratch resistance due to ink pigments 11 forming an image on the upper portion of the protective layer of the respective test samples. That is, ink pigments 11 remaining on the upper surface may be readily susceptible to external forces such as sharp objects and/or rough surfaces. Alternatively, when the particle size of the polymeric beads in the protective layer was greater than ten microns, such as in Examples #3 and #4, the ink pigments 11 passed through and penetrated the upper portion of the protective layer. That is, the ink pigments 11 rested below and/or were distributed within the lower portion of the protective layer as illustrated in FIG. 2 which is a scanning electron microscope photomicrograph of Example 4 in Table 2. Consequently, the ink pigments 11 were not readily exposed to external forces applied to the top surface of the protective layer. Thus, durability such as scratch resistance of the printed images has been increased.

TABLE 1

Formulations for Examples 1-5

| | Example #1 | Example #2 | Example #3 | Example #4 | Example #5 |
|---|---|---|---|---|---|
| Name of polymeric beads | Ultralube MD2000 | Ultralube E846 | Slip Ayd SL18 | Slip Ayd SL300 | DPP 756A |
| Amount of Beads | 100 parts | 100 parts | 100 parts | 100 parts | 100 parts |
| Acrynol S728 | 12 parts | 12 parts | 12 parts | 12 parts | 12 parts |
| Mowiol 40-88 | 0.5 parts | 0.5 parts | 0.5 parts | 0.5 parts | 0.5 parts |
| Tegowet 510 | 0.5 parts | 0.5 parts | 0.5 parts | 0.5 parts | 0.5 parts |

TABLE 2

Average particle size of polymeric beads in examples 1-5 and their testing results

| | Example #1 | Example #2 | Example #3 | Example #4 | Example #5 |
|---|---|---|---|---|---|
| Average particle size of pigment | 1-2 μm | 0.15-0.25 μm | 10-15 μm | 15-20 μm | 0.1-0.2 μm |
| General image quality | Very bad, a lot of bleeding | Very bad, a lot of bleeding | Okay, image slightly blurred | Good, no obvious defects | Good, no obvious defects |
| Finger nail scratch testing before calendering | Very bad, ink easily removed | Very bad, ink easily removed | Good, no ink removed | Good, no ink removed | Very bad, ink easily removed |
| Finger nail scratch testing after calendaring | Very bad, ink easily removed | Very bad, ink easily removed | Good, no ink removed | Good, no ink removed | Bad, ink removed with strong force |

FIG. 3 is a block diagram illustrating a printing system to apply pigmented ink including ink pigments to a recording medium according to an example. Referring to FIG. 3, in some examples, a printing system 310 includes an ink applicator unit 33, a recording medium transport unit 35, and a post-treatment unit 37. The recording medium transport unit 35 may transport a recording medium 100 to and from a print zone. For example, the recording medium transport unit 35 may include rollers, belts, trays, or the like. The ink applicator unit 33 may apply pigmented ink including ink pigments to the recording medium 100 to form an image when the recording medium 100 is placed in the print zone. For example, the ink applicator unit 33 may be an inkjet printhead, developer unit, or the like. In some examples, the printing system 310 may also include a post-treatment unit 37 to subject the recording medium 100 to a post-treatment process after pigmented ink is applied to the recording medium 100. For example, the post-treatment unit 37 may include a heating unit, a pressure applicator unit, microwave unit, an infrared radiation unit, a UV light unit, or the like. In some examples, the post-treatment unit 37 may transform the respective shape of each one of the first set of the polymeric beads 18 after the ink pigments 11 is transported there between. For example, spherical polymeric beads may soften and/or melt and become distorted when subjected to the post-treatment unit 37.

Figure 4:
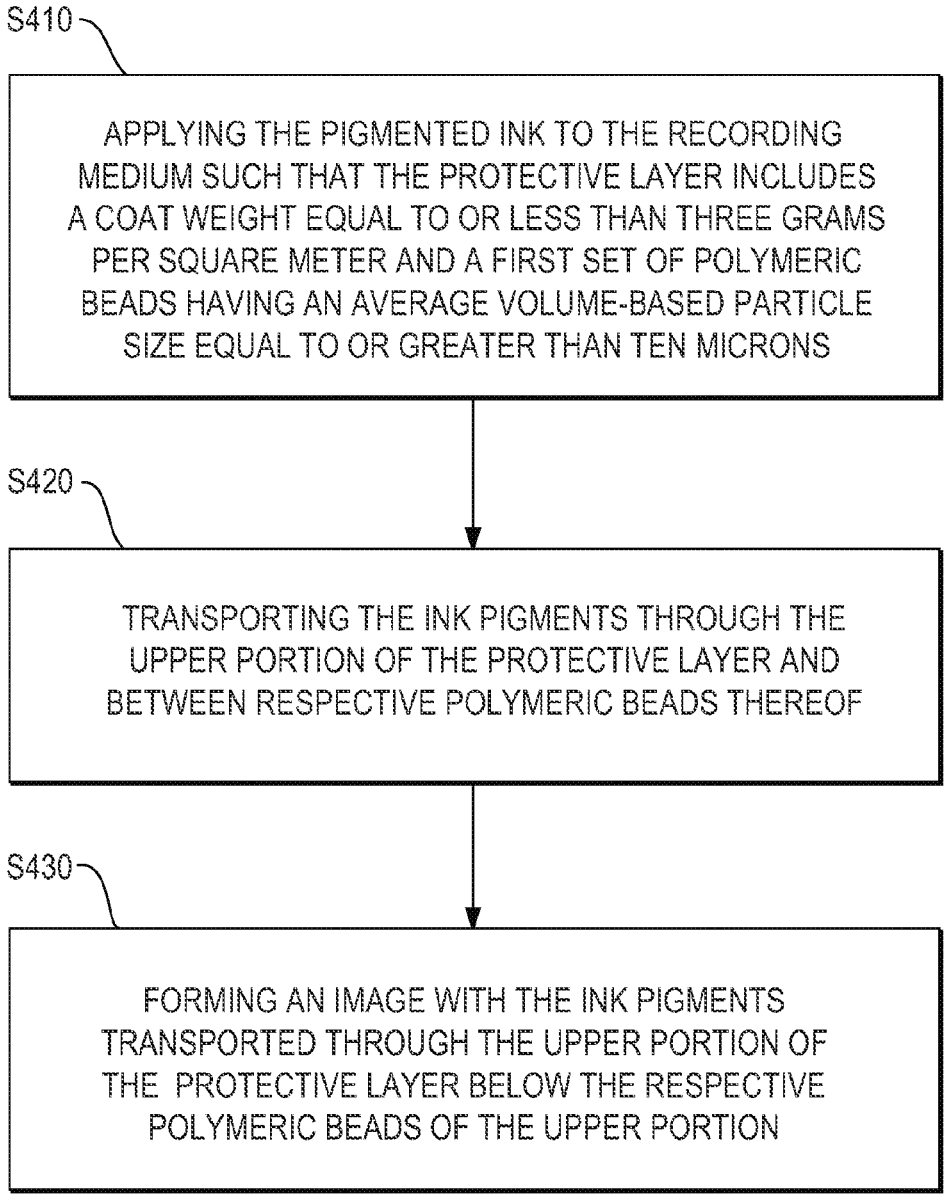
FIG. 4 is a flowchart illustrating a method of printing pigmented ink including ink pigments onto a recording medium including a protective layer having an upper portion and a lower portion disposed below the upper portion each with a height equal to one half of a total height of the protective layer according to an example.

FIG. 4 is a flowchart illustrating a method of printing pigmented ink including ink pigments onto a recording medium including a protective layer having an upper portion and a lower portion disposed below the upper portion each with a height equal to one half of a total height of the protective layer according to an example. Referring to FIG. 4, in block S410, the pigmented ink is applied to the recording medium such that the protective layer includes a coat weight equal to or less than three gsm and a first set of polymeric beads having an average volume-based particle size equal to or greater than ten microns. In some examples, the first set of polymeric beads may each have a shape and be at least one of translucent and transparent. The first set of polymeric beads may have a melting temperature in a range between fifty ° C. and two hundred fifty ° C. For example, the first set of polymeric beads may have a melting temperature in a range between eighty ° C. and one hundred and fifty ° C.

In block S420, the ink pigments are transported through the upper portion of the protective layer and between respective polymeric beads thereof. In some examples, a respective shape of each one of the first set of the polymeric beads may be maintained while the ink pigments are transported there between. In block S430, an image is formed with the ink pigments transported through the upper portion of the protective layer below the respective polymeric beads of the upper portion. In some examples, the ink pigments may also be transported through the lower portion of the protective layer and/or distributed within the lower portion. In some examples, the ink pigments may reside on and/or within the porous ink receiving layer. The method may also include transforming the respective shape of each one of the first set of the polymeric beads after the ink pigments are transported there between through application of a post-treatment unit.

It is to be understood that the flowchart of FIG. 4 illustrates architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be scrambled relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A recording medium, comprising:

a base substrate;

a protective layer including a first binder and a first set of polymeric beads, the first set of polymeric beads having an average volume-based particle size equal to or greater than ten microns, wherein the first set of polymeric beads is at least one of:

selected from the group consisting of at least one of paraffin, polybutadiene, polyurethane, epoxy resin, silicone resin, polyamide resin, a latex resin selected from the group consisting of at least one of styrene, styrene acrylate, styrene acrylic, ester, acrylic, acrylate, methylacrylate, vinyl ester, vinyl ether, and vinyl ketone; and a natural polymer selected from the group consisting of at least one of natural wax, gelatin, gelatin derivative, starch, and starch derivative; and a porous ink receiving layer disposed between the base substrate and the protective layer, the porous ink receiving layer including a first set of pigments and a second binder;

wherein the protective layer has a coat weight equal to or less than three grams per square meter.

2. The recording medium according to claim 1, wherein the first set of polymeric beads is at least one of translucent and transparent.

3. The recording medium according to claim 1, wherein the first binder comprises at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin.

4. The recording medium according to claim 1, wherein the melting temperature of the first set of polymeric beads is in a range between fifty ° C. and two hundred fifty ° C.

5. The recording medium according to claim 1, wherein the melting temperature of the first set of polymeric beads is in a range from eighty ° C. to one hundred and fifty ° C.

6. The recording medium according to claim 1, wherein the first set of pigments of the porous ink receiving layer comprises at least one of fumed silica, colloidal silica, precipitated silica, silica gel, boehmite, alumina, titanium dioxide, precipitated calcium carbonate, grounded calcium carbonate, clay, and calcined clay.

7. A recording medium to receive pigmented ink including ink pigments to form images thereon, the recording medium, comprising:

a base substrate;

a protective layer having a coat weight equal to or less than three grams per square meter, the protective layer including a first binder and a first set of polymeric beads;

the first set of polymeric beads having an average diameter equal to or greater than ten microns and a melting temperature in a range between fifty ° C. and two hundred fifty ° C., wherein the first set of polymeric beads is at least one of:

selected from the group consisting of at least one of paraffin, polybutadiene, polyurethane, epoxy resin, silicone resin, polyamide resin, a latex resin selected from the group consisting of at least one of styrene, styrene acrylate, styrene acrylic, ester, acrylic, acrylate, methlacrylate, vinyl ester, vinyl ether, and vinyl ketone; and a natural polymer selected from the group consisting of at least one of natural wax, gelatin, gelatin derivative, starch, and starch derivative; and a porous ink receiving layer disposed between the base substrate and the protective layer, the porous ink receiving layer including a first set of pigments and a second binder;

wherein the first set of polymeric beads is at least one of translucent and transparent.

8. A method of making a recording medium, comprising:

applying a porous ink receiving layer including a first set of pigments and a second binder to a base substrate;

applying a protective layer including a first binder and a first set of polymeric beads to the porous ink receiving layer, wherein the first set of polymeric beads includes an average volume-based particle size equal to or greater than ten microns, and wherein the first set of polymeric beads is at least one of:

selected from the group consisting of at least one of paraffin, polybutadiene, polyurethane, epoxy resin, silicone resin, polyamide resin, a latex resin selected from the group consisting of at least one of styrene, styrene acrylate, styrene acrylic, ester, acrylic, acrylate, methylacrylate, vinyl ester, vinyl ether, and vinyl ketone; and a natural polymer selected from the group consisting of at least one of natural wax, gelatin, gelatin derivative, starch, and starch derivative; and drying the porous ink receiving layer and the protective layer on the base substrate, thereby forming the recording medium.

9. The method according to claim 8, wherein the first set of polymeric beads each has a shape and is at least one of translucent and transparent.

10. The method according to claim 8, wherein the first set of polymeric beads has a melting temperature in a range between fifty ° C. and two hundred fifty ° C.

11. The method according to claim 8 wherein the porous ink receiving layer and the protective layer are applied by pond coating, Meyer rod coating, blade coating, air-knife coating, or curtain coating.

12. The method according to claim 8 wherein the protective layer has a coat weight that is equal to or less than three gsm.

13. The method according to claim 8 wherein the base substrate further includes a coating layer disposed between the base substrate and the porous ink receiving layer.

14. The method according to claim 8 wherein the coating layer includes at least one of an inorganic pigment, a binder, polymeric resins, or combinations thereof.

* * * * *